United States Patent [19]

Yamamoto

[11] Patent Number: 5,066,989

[45] Date of Patent: Nov. 19, 1991

[54] CLEANING METHOD FOR USE IN COPY APPARATUS AND TONER USED THEREFOR

[75] Inventor: Hajime Yamamoto, Ibaraki, Japan

[73] Assignee: Matsushita Electric Industrial Co., Ltd., Osaka, Japan

[21] Appl. No.: 578,279

[22] Filed: Sep. 6, 1990

[30] Foreign Application Priority Data

Sep. 26, 1989 [JP] Japan ..... 1-249531

[51] Int. Cl.[5] ..... G03G 15/06

[52] U.S. Cl. ..... 355/270; 355/269; 430/125

[58] Field of Search ..... 355/269, 270, 326; 430/45, 106.6, 125

[56] References Cited

U.S. PATENT DOCUMENTS

| | | | |
|---|---|---|---|
| 4,502,780 | 3/1985 | Suzuki et al. | 430/125 X |
| 4,827,869 | 4/1989 | Takagi | 355/326 X |
| 4,868,608 | 9/1989 | Allen et al. | 430/125 X |

FOREIGN PATENT DOCUMENTS

| | | | |
|---|---|---|---|
| 2908565 | 9/1979 | Japan | 430/106.6 |
| 2-46474 | 2/1990 | Japan . | |

*Primary Examiner*—A. T. Grimley
*Assistant Examiner*—P. J. Stanzione
*Attorney, Agent, or Firm*—Stevens, Davis, Miller & Mosher

[57] ABSTRACT

A cleaning method is provided for use in a color electrophotographic apparatus in which color toner images formed by using a plurality of color toners on a photosensitive medium by repeating charging, exposure and reverse-developing steps are transferred to a sheet of paper at one stroke. The toners include color toners and a black toner. Each of the color toners is a toner for a DC electric field jump developing method which serves to develop without making contact with the photosensitive medium. The black toner is a toner for a two-component magnetic brush developer which is mixed with a carrier to be used. The two-component magnetic brush developer is used both as a developer serving to develop in contract with the photosensitive medium and a cleaning agent serving to clean the toners remaining on the photosensitive medium after the transfer operation. Further, the color toners and black toner are charged, when mixed with the two-component magnetic brush developer, to have a polarity which is the same as the polarity thereof at the time of developing.

5 Claims, 2 Drawing Sheets

CLEANING METHOD FOR USE IN COPY APPARATUS AND TONER USED THEREFOR

BACKGROUND OF THE INVENTION

1. Field of the Invention

The present invention relates to a toner and a cleaning method using the same which are available for hard copy apparatus such as a copying machine and a printer.

2. Description of the Prior Art

At present, in an electrophotographic apparatus widely used in the copying machine and laser printer, fields it is well known to form a sheet of toner image on a plain paper by a method in which, after the formation of an electrostatic latent image on an electrostatic latent image carrier body such as an electrophotographic photoconductor, for example, the image is developed by a charged toner electrostatically and is then transferred onto plain paper by means of a corona transfer device which is applied with a voltage of a polarity opposite to that of the toner.

Examples of such apparatus include an apparatus which has been proposed by the present inventors in Japanese Patent Unexamined Publication No. 2-46474. The outline of this apparatus will be described by referring to FIG. 2.

Developing units 1, 2, 3 are non-magnetic one-component developing units of non-contact type in each of which a toner is made to jump in a DC electric field. Conductive fur brushes 4, 5, 6 which are in contact with developing rollers serve to charge frictionally the toners, and blades 10, 11, 12 serve to form thin layers of toners on the aluminum developing rollers 7, 8, 9, respectively. The developing units 1, 2 and 3 hold insulating toners of yellow (Y), magenta (M) and cyan (C), respectively. A black developing unit 13 is a contact type developing unit which is widely used in the electrophotographic apparatus and holds a two-component developer composed of an insulating toner and a magnetic carrier. The developing units are arranged around a photosensitive medium 15 keeping a space between the developing rollers 7, 8, 9, 14 and the photosensitive medium 15. Each developing unit is equipped with a mechanism by means of which it is moved close to and away from the photosensitive medium 15 at the time of developing and non-developing, respectively.

An amorphous Se-Te photosensitive drum 15 serving as the photosensitive medium is charged to an electric potential of +900 V by a charger 16. Subsequently, a semiconductor laser 17 emits light to expose negative black signals onto the photosensitive medium 15 to form an electrostatic latent image. The latent image thus formed is reversed-developed by the black developing unit 13 in the developing condition that the developing roller 14 is applied with a voltage of +600 V, thus forming a black toner image. Then, the charge of the photosensitive medium 15 is once discharged by an AC corona charger 18. Subsequently, the photosensitive medium 15 is charged again to +600 V by the corona charger 16. Thereafter, the semiconductor laser 17 emits light to expose signals corresponding to yellow onto the photosensitive medium 15 to form an electrostatic latent image of yellow. Then, the photosensitive medium is made to pass through the yellow developing unit 1 in the developing condition that the developing roller 7 is applied with +600 V, as well as the magenta developing unit 2, the cyan developing unit 3 and the black developing unit 13 which are in the non-developing condition, thus forming a yellow toner image. Next, the charge of the photosensitive medium 15 is discharged by the AC corona charger 18 and, thereafter, the photosensitive medium 15 is charged again to +810 V by the corona charger 16. Then, the semiconductor laser 17 emits light to expose signals corresponding to magenta to form an electrostatic latent image of magenta. Subsequently, the photosensitive medium 15 is made to pass through the yellow developing unit 1 in the non-developing condition and the magenta developing unit 2 in the developing condition that the developing roller 8 is applied with +800 V, thus forming a magenta toner image. Thereafter, the photosensitive medium 15 is made to pass through the cyan developing unit 3 and the black developing unit 13 which are in the non-developing condition. Then, after the charge of the photosensitive medium 15 is discharged by the AC corona charger 18, the photosensitive medium 15 is charged again to +850 V by the corona charger 16. Thereafter, the semiconductor laser 17 emits light to expose signals corresponding to cyan to form an electrostatic latent image of cyan. Subsequently, the photosensitive medium 15 is made to pass through the yellow developing device 1 and the magenta developing unit 2 which are in the non-developing condition, and through the cyan developing unit 3 in the developing condition that the developing roller 9 is applied with +830 V, thus forming a cyan toner image. In this way, a color image is built up on the photosensitive medium 15.

A sheet of plain paper 19 is conveyed on a transfer belt 21 while being in contact with a fur brush 20 of stainless steel which is applied with a voltage of +1 kV, and made to pass through between the brush and a paper attraction charger 22 to be brought into close contact with the transfer belt 21. After the color toner image formed on the photosensitive medium 15 is transferred onto this paper 19 by means of a transfer charger 23, the paper is charged by a paper detach charger 24 and then separated from the transfer belt 21. The paper thus separated is made to pass through between a pair of chargers including a positive charger 25 and a negative charger 26 so as to be charged and, in addition, made to pass through a fixing unit 27 for ensuring the thermal fixing.

The electrophotographic process in which a plurality of color toner images superimposed on the photosensitive medium are transferred to the paper simultaneously suffers from a problem in that a large quantity of toner remains on the photosensitive medium after the transfer operation. The quantity of the remaining toner in this process is greater than that in the conventional monochrome type. To cope with this, in this apparatus, a conductive fur brush which is applied with a DC voltage is used to attract and remove the remaining toner by a strong electrostatic force. This method, however, suffers from a problem in that not only is a larger and more complex driving device required for rotating the fur brush but also the toners are scattered as the fur brush rotates.

For this reason, there has been made an attempt to adopt a magnetic brush cleaning method which has conventionally been used in part in the monochrome copying machine, making use of the feature of this color electrophotographic apparatus that the color toners are developed in a non-contact manner but the black toner is developed in a contact manner. This magnetic brush cleaning method is one wherein a bias voltage having a polarity opposite to that for development is applied to a two-component magnetic brush developer used for the development so as to attract and remove electrostatically the toner remaining on the photosensitive medium. As a result, not only is the apparatus simplified and reduced in size, but also very satisfactory cleaning results were obtained so far as the apparatus was used under ordinary conditions.

However, there arose another different problem under high humidity conditions. Namely, the color toners of yellow, magenta and cyan are one-component toners which are charged frictionally with the fur brushes, while a black toner is the two-component toner which is charged frictionally with the carrier, and therefore, mixing of the one-component color toners into the two-component black developer caused the color toners to be charged frictionally again with the carrier to be made gradually to have a polarity opposite to their inherent charged polarity under high humidity conditions, resulting at last in a poor cleaning performance.

SUMMARY OF THE INVENTION

In view of the above points, an object of the present invention is to provide a cleaning method for use in an apparatus in which a full-color image obtained by superimposing color toner images on a photosensitive medium is transferred to a paper at one stroke and a color toner used therefor, the cleaning method enabling a black developing unit to be used also as a cleaning device for the photosensitive medium as well as enabling the apparatus to be reduced in size without deteriorating developing and cleaning performances.

According to the present invention, there is provided a cleaning method for use in a color electrophotographic apparatus in which color toner images formed by using a plurality of color toners on a photosensitive medium by repeating charging, exposure and reversal developing steps are transferred to a sheet of paper at one stroke, the method comprising the steps of providing the toners including color toners and a black toner, each of the color toners being a toner for a DC electric field jump developing method which serves to achieve development without making contact with the photosensitive medium and the black toner being a toner for two-component magnetic brush developer and being mixed with a carrier to be charged, and using the two-component magnetic brush developer as a cleaning agent serving to clean the toners remaining on the photosensitive medium after the transfer operation, the two-component magnetic brush developer being also used as a developer serving to develop in contact with the photosensitive medium.

Further, according to the present invention, there is provided a set of toners for use in a color electrophotographic apparatus in which color toner images formed by using a plurality of color toners on a photosensitive medium by repeating charging, exposure and inversion-developing steps are transferred to a paper at one stroke, wherein the toners include color toners and a black toner, each of the color toners being a toner a DC electric field jump developing method which serves to develop without making contact with the photosensitive medium and the black toner being a toner for two-component magnetic brush developer and being mixed with a carrier to be charged, the two-component magnetic brush developer being used both as a developer serving to develop in contact with the photosensitive medium and a cleaning agent serving to clean the toners remaining on the photosensitive medium after the transfer operation, and wherein the color toners and black toner are charged, when mixed with the two-component magnetic brush developer, to have a polarity which is the same as the polarity thereof at the time of developing.

It may be effected in the color electrophotographic process that the contact developing method is used for only one color. It will result in color impurity at the time of developing if all the four colors are used in the contact developing method. For this reason, the contact developing method is used at first for developing one color, and then, the photosensitive medium is developed by the non-contact developing method. After transferring the toner to the paper, the first color developer is made to come in contact with the photosensitive medium to clean the same. This one color is preferably black from the viewpoint of hue.

Furthermore, the properties of toners available for this method are as follows. It is well known that the optimum value of charge of toner to be used depends on the developing methods. For example, in the DC electric field jump developing method used for the color toners as described in the above conventional apparatus, the one-component toner is charged to about 3 $\mu C/g$ by friction with the fur brush or sponge provided in the developing unit, this amount of charge being suitable for this developing method. On the other hand, in the two-component developing method used for the black toner, the black toner is mixed with the carrier to be charged frictionally to a higher charge amount of 15 $\mu C/g$. In this case, if the black two-component magnetic brush developer is used for cleaning the color toners remaining on the photosensitive medium after the transferring operation, the color toners will be caused to pour into and mix with the two-component magnetic brush developer. Since the initial charge amount of the color toners is low, the polarity of the charged toners may be reversed in some cases at high humidities depending upon the materials of the toner when the toners are mixed in and stirred with the carrier of the two-component developer. Generation of a large quantity of toners having the reversed polarity in the two-component developer results in heavy fog. It is therefore impossible to clean electrostatically the photosensitive medium using such developer.

Examples of the binder resin of the toner include in general a phenol resin, a paraffin wax, a vinyl chloride resin, a styrene resin, an alkyd resin, a styrene-acryl resin, a polyester resin and an epoxy resin. As a result of examination of these various materials, it is found that when the styrene-acryl resin, the polyester resin or the epoxy resin is used as the binder resin of the toner, the polarity of the color toner for DC electric field jump developing use is prevented from being reversed even when the color toner is poured into and mixed with the two-component magnetic brush developer, thus establishing a charge with the stable polarity. In consequence, it is proved that the black two-component magnetic brush developer can be used also as the cleaning agent provided that the toners using these binder resin are used.

DETAILED DESCRIPTION OF THE PREFERRED EMBODIMENTS

There is known as a photosensitive medium applicable to the present invention an electrophotographic sensitive medium which is obtained by forming on a conductive material such as aluminum a film of a photoconductive material such as amorphous selenium, zinc oxide, polyvinyl carbazole or amorphous silicon.

Binder resins available for a toner of a black developer used concurrently for cleaning include a polyester resin, a styrene-acryl resin and an epoxy resin, for example. These binder resins may be used in various combinations, e.g., a common resin can be used for both black and color toners, or the acryl resin and the polyester resin can be used for the black toner and the color toner, respectively.

Description will be given below of practical embodiments of the present invention in more detail.

Practical Embodiment 1

Figure 1:
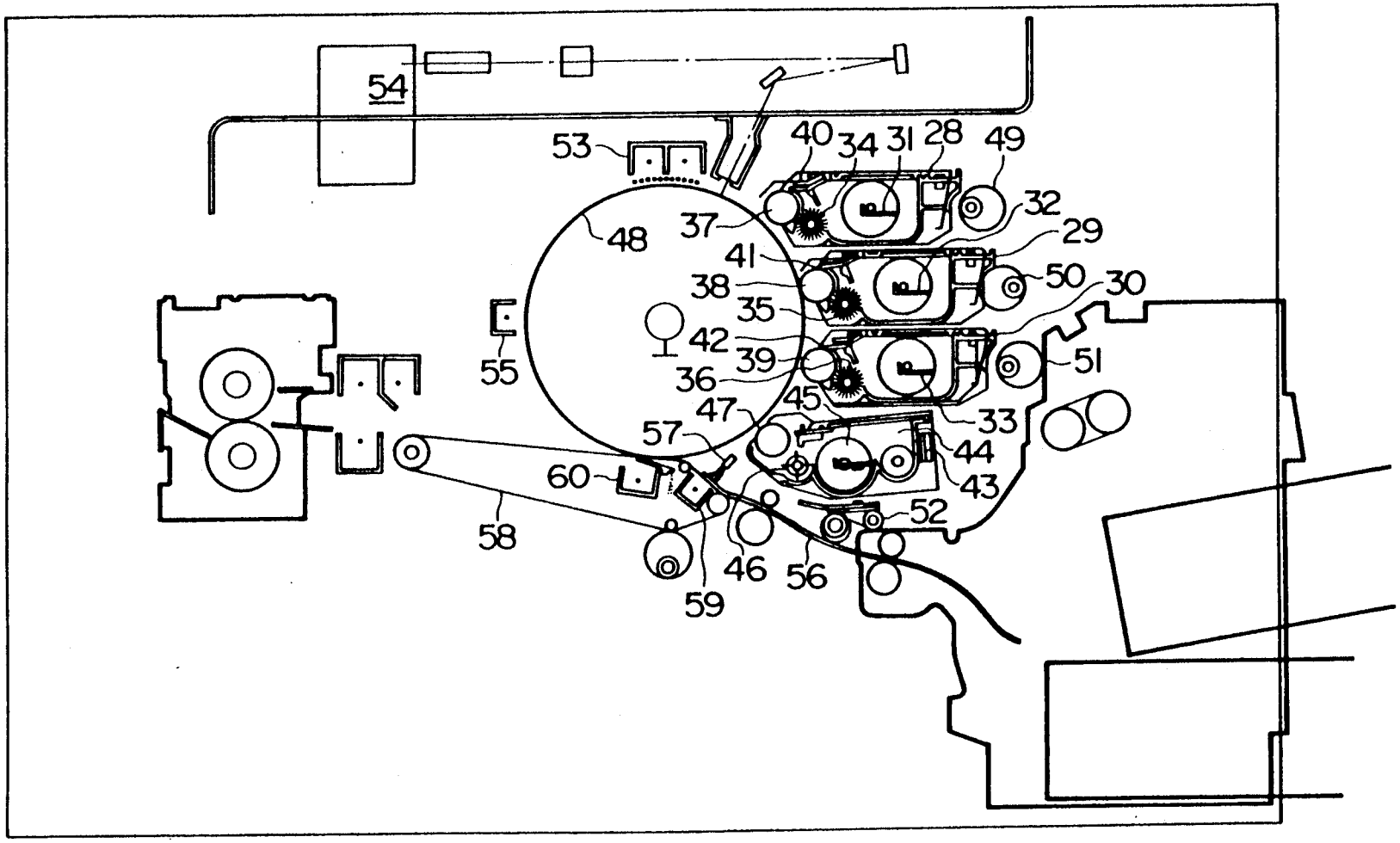
FIG. 1 is a schematic view of an embodiment of a color electrophotographic apparatus using a toner and a cleaning method in accordance with the present invention.
Figure 2:
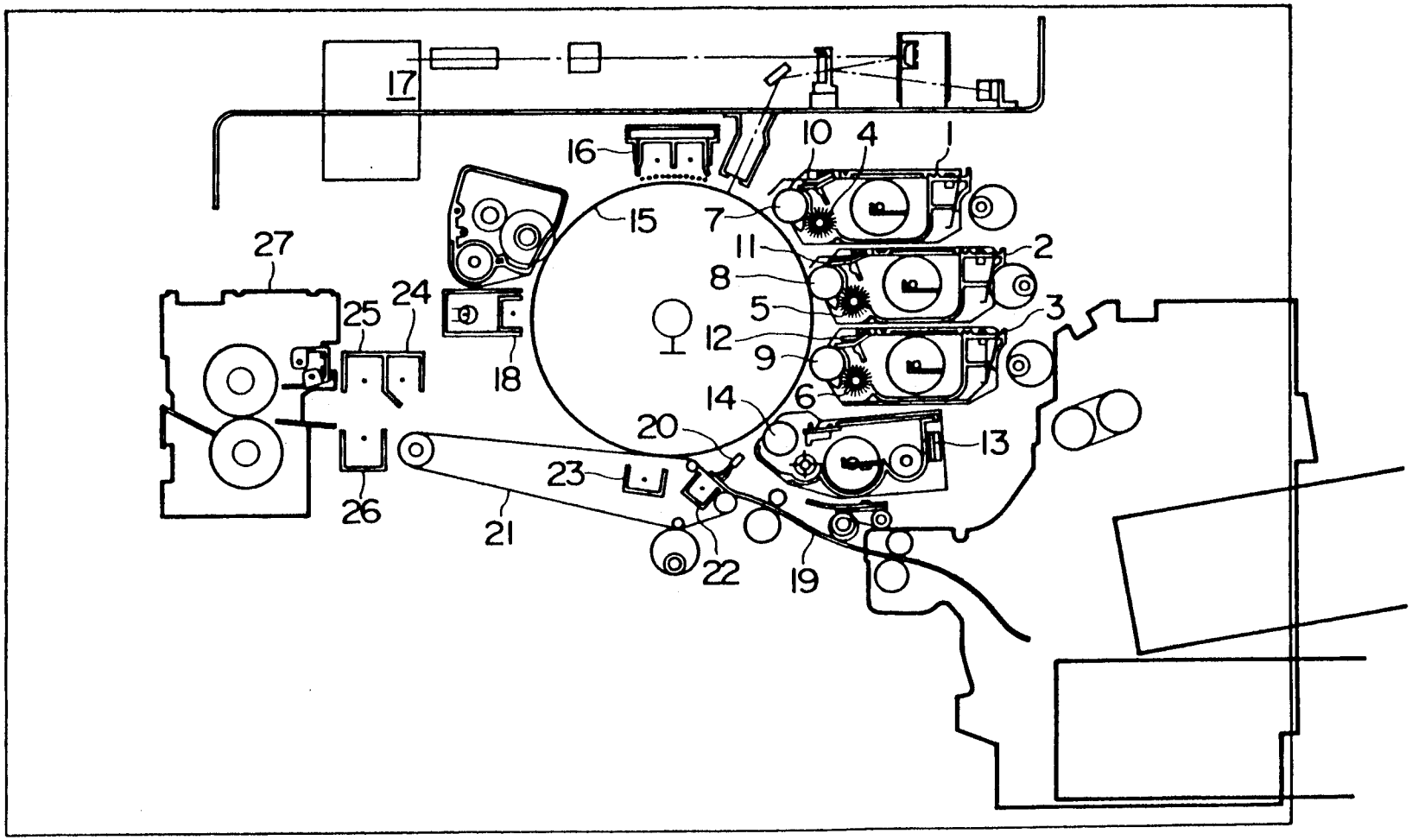
FIG. 2 is a schematic view of a conventional electrophotographic apparatus.

A polyester resin, which has a condensation polymer of terephthalic acid and butanediol for its main ingredient, is used as the binder resin for the color toners of yellow, magenta and cyan and for the black toner. Pigments for respective color toners (3 weight parts) are dispersed into the polyester resin together with positive charge adjusting agent (3 weight parts) to be mixed up, kneaded and crushed. These mixtures were then pulverized to prepare the toners. Using these toners, an apparatus shown in FIG. 1 is operated to form a color image.

Developing units 28, 29 and 30 are non-magnetic one-component developing units of non-contact type in each of which a toner is made to jump in a DC electric field. The toners in the respective developing units are brought toward developing rollers by means of toner supply blades 31, 32 and 33 to be charged frictionally with conductive fur brushes 34, 35 and 36 which are in contact with their respective associated developing rollers. The toners thus charged are formed into a thin layer on the aluminum developing rollers 37, 38 and 39 by means of blades 40, 41 and 42, respectively. The developing units 28, 29 and 30 hold insulating toners of yellow (Y), magenta (M) and cyan (C), respectively. A black developing unit 43 is a contact type developing unit which is widely used in the electrophotographic apparatus and holds a two-component developer composed of an insulating toner and a magnetic carrier. The toner is fed from the outside into the developing unit 43 by means of a toner supply coil 44, mixed with the carrier by means of a developer stirring blade 45, and then supplied through a developer supply blade 46 to a developing roller 47 which has a magnetic roller built therein. The developing units are arranged around and disposed opposite to a photosensitive medium 48 leaving a uniform spacing (developing gap) between the developing rollers 37, 38, 39, 47 and the photosensitive medium 48. Each developing unit is equipped with a mechanism 49, 50, 51 or 52 by means of which it is moved close to and away from the photosensitive medium 48 at the time of developing and non-developing, respectively.

Specifications and developing conditions of the black developing unit 43 and physical properties of the used toner will be described in the following.

Specifications and Developing Conditions of Developing Unit

Diameter of the developing roller 47: 22 mm

Circumferential speed of the developing roller 47: 320 mm/s.

Thickness of developer layer on the developing roller 47: 400 μm.

Rotating direction of the developing roller 47: reverse to the rotating direction of the photosensitive medium 48 (i.e., the same forward direction).

Developing gap (gap between developing roller surface and photosensitive medium surface): 300 μm at the time of developing and 2 mm at the time of non-developing.

Physical Properties of Developer

Type of developer: two-component developer composed of toner and carrier.

Average particle size of carrier: about 60 μm.

Type of carrier: silicon resin coated ferrite.

Toner charge amount: +15 PC/g.

Average particle size of toner: 12 μm.

Binder resin of toner: polyester resin.

Specific permittivity of toner: about 2.

Specifications and developing conditions of the developing units for yellow, magenta and cyan and physical properties of the used toners will be described in the following.

Specifications and Developing Conditions of Developing Units

Diameter of developing rollers: 20 mm

Circumferential speed of developing rollers: 160 mm/s.

Rotating direction of developing rollers: reverse to the rotating direction of the photosensitive medium 48 (i.e., the same forward direction).

Thickness of toner layers on developing rollers: 30 μm.

Developing gap (gap between developing roller surfaces and photosensitive medium surface): 150 μm at the time of developing and 2 mm at the time of non-developing.

Physical Properties of Toners

Toner charge amount: +3 PC/g.

Average particle size: 12 μm.

Binder resin of toner: polyester resin.

Specific permittivity: about 2.

An amorphous Se-Te photosensitive drum 48 of diameter 152.8 mm (a function-separate type selenium photosensitive medium increasing sensitivity at the long wavelength band in the infrared area, the thickness of photosensitive layer being 63 μm, the specific permittivity being about 7, and the half decay exposure at the wavelength of 790 nm being 0.6 $\mu J/cm^2$) was used as the photosensitive medium and rotated at the circumferential speed of 160 mm/s. This photosensitive medium 48 was charged to an electric potential of +900 V by a charger 53 (scorotron charger, corona voltage: +7 kV, grid voltage: 1 kV). Subsequently, a semiconductor laser 54 of the wavelength of 790 nm emitted light to make exposure. In this case, the intensity of light on the photosensitive medium surface was set at 1.5 mW. This semiconductor laser 54 served to expose negative black signals onto the photosensitive medium 48 to form an electrostatic latent image. The latent image thus formed was reverse developed by the black developing unit 43 in the developing condition that the developing roller 47 was applied with a voltage of +600 V, thus forming a black toner image. Then, charge of the photosensitive medium 48 was once discharged by an AC corona charger 55 (applied AC voltage: 4.5 kVrms, DC bias component: +200 V).

Subsequently, the photosensitive medium 48 was charged again to +600 V by the corona charger 53 (scorotron charger, corona voltage: +7 kV, grid voltage: +600 V). Thereafter, the semiconductor laser 54 emitted light to expose signals corresponding to yellow onto the photosensitive medium 48 to form an electrostatic latent image for yellow. Then, the photosensitive medium was made to pass through the yellow developing unit 28 in the developing condition that the developing roller 37 was applied with +600 V, as well as the magenta developing unit 29, the cyan developing unit 30 and the black developing unit 43 which were in the non-developing condition, thus forming a yellow toner image. Next, the charge of the photosensitive medium 48 was discharged by the AC corona charger 55 (applied AC voltage: 4.5 kVrms, DC bias component: +200 V) and, thereafter, the photosensitive medium 48 was charged again to +810 V by the corona charger 53 (scorotron charger, corona voltage: +7 kV, grid voltage: +940 V). Then, the semiconductor laser 54 emitted light to expose signals corresponding to magenta to form an electrostatic latent image for magenta. Subsequently, the photosensitive medium 48 was made to pass through the yellow developing unit 28 in the non-developing condition and the magenta developing unit 29 in the developing condition that the developing roller 38 was applied with +800 V, thus forming a magenta toner image. Thereafter, the photosensitive medium 48 was made to pass through the cyan developing unit 30 and the black developing unit 43 which were in the non-developing condition. Then, after the charge of the photosensitive medium 48 was discharged by the AC corona charger 55 (applied AC voltage: 4.5 kVrms, DC bias component: +200 V), the photosensitive medium 48 was charged again to +850 V by the corona charger 53. Thereafter, the semiconductor laser 54 emitted light to expose signals corresponding to cyan to form an electrostatic latent image for cyan. Subsequently, the photosensitive medium 48 was made to pass through the yellow developing unit 28 and the magenta developing unit 29 which were in the non-developing condition, and through the cyan developing unit 30 in the developing condition that the developing roller 39 was applied with +830 V, thus forming a cyan toner image. In this way, a color image was made up on the photosensitive medium 48.

A sheet of plain paper 56 was conveyed on a transfer belt 58 while being in contact with a fur brush 57 of stainless steel which was applied with a voltage of +1 kV, and made to pass through between the brush and a paper attraction charger 59 (applied voltage: −6 kV) to be brought into close contact with the transfer belt 58. Then, after the color toner image was transferred onto the paper 56 by means of a transfer charger 60 (transfer voltage: −6 kV), the surface of the photosensitive medium 48 was subjected to corona exposure by means of the corona charger 55 (applied AC voltage: 4.5 kVrms, DC bias component: +800 V) so that the photosensitive medium 48 was uniformly charged to +500 V. Thereafter, the toners remaining on the photosensitive medium were removed completely by means of the black developing unit 43 with the developing roller 47 applied with −100 V.

Even after repeating the above process 10000 times in an environment kept at a temperature 30° C. and a relative humidity 80%, the polarity of the color toners could be maintained positive within the black developer, thus causing no problem of poor cleaning performance.

Practical Embodiment 2

A color image was formed by the color electrophotographic apparatus shown in FIG. 1 using as the binder resin for toners a styrene-acryl resin which is a copolymer of n-butyl-methacrylate (30 weight parts) and styrene (70 weight parts).

The color image forming process on the photosensitive medium was quite the same as that of the practical embodiment 1.

As a result, even after repeating the process 10000 times, the polarity of the color toners could be maintained positive within the black developer, thus causing no problem of poor cleaning performance.

Practical Embodiment 3

A color image was formed by the color electrophotographic apparatus shown in FIG. 1 using as the binder resin for toners an epoxy resin which is a copolymer of bisphenol A and ethylene oxide.

The color image forming process on the photosensitive medium was quite the same as that of the practical embodiment 1.

As a result, even after repeating the process 10000 times, the polarity of the color toners could be maintained positive within the black developer, thus causing no problem of poor cleaning performance.

Comparison 1

A color image was formed by the color electrophotographic apparatus shown in FIG. 1 using a polyvinylchloride resin as the binder resin for toners.

The color image forming process on the photosensitive medium was quite the same as that of the practical embodiments.

As a result, after repeating the process 2000 times, the polarity of the color toners was changed to negative in the two-component black developer, thereby causing not only adverse contamination of the photosensitive medium at the time of cleaning but also fog at the time of black developing, thus giving rise to a problem of remarkable deterioration of the image quality.

According to the present invention, it is possible to obtain a cleaning method for use in an apparatus in which a full-color image obtained by superimposing color toner images on a photosensitive medium is transferred to a paper at one stroke and a color toner used therefor, the cleaning method enabling a black developing unit to be used also as a cleaning device for the photosensitive medium as well as enabling the apparatus to be reduced in size without deteriorating cleaning performance.

What is claimed is:

1. A cleaning method for use in a color electrophotographic apparatus in which color toner images formed by using a plurality of color toners on a photosensitive medium by repeating charging, exposure and reversal developing steps are transferred to a sheet of paper at one stroke, the method comprising the steps of:

providing said toners including color toners and a black toner, each of said color toners being a toner for a DC electric field jump developing method which serves to develop without making contract with the photosensitive medium and said black toner being a toner for a two-component magnetic brush developer and being mixed with a carrier to be charged, and using said two-component brush developer as a cleaning agent serving to clean the toners remaining on the photosensitive medium after a transfer operation, said two-component brush developer being also used as a developer serving to develop in contract with the photosensitive medium.

2. A set of toners for use in a color electrophotographic apparatus in which color toner images formed by using a plurality of color toners on a photosensitive medium by repeating charging, exposure and inversion-developing steps are transferred to a sheet of paper at one stroke, wherein said toners include color toners and a black toner, each of said color toners being a toner for a DC electric field jump developing method which serves to develop without making contact with the photosensitive medium and said black toner being a toner for a two-component magnetic brush developer and being mixed with a carrier to be charged, said two-component magnetic brush developer being used both as a developer serving to develop in contact with the photosensitive medium and a cleaning agent serving to clean the toners remaining on the photosensitive medium after a transfer operation, and wherein said color toners and said black toner are charged, when mixed with said two-component magnetic brush developer, to have a polarity which is the same as the polarity thereof at the time of developing.

3. A set of toners according to claim 2, wherein a binder resin sued for said color toners and said black toner is a styrene-acryl resin.

4. A set of toners according to claim 2, wherein a binder resin used for said color toners and said black toner is a polyester resin.

5. A set of toners according to claim 2, wherein a binder resin used for said color toners and said black toner is an epoxy resin.

* * * * *